US010300689B2

(12) United States Patent
Fernandez Espasa et al.

(10) Patent No.: US 10,300,689 B2
(45) Date of Patent: May 28, 2019

(54) MODIFYING PRINTING BASED ON CROSS-WEB DISTORTIONS

(71) Applicant: HEWLETT-PACKARD DEVELOPMENT COMPANY, L.P., Houston, TX (US)

(72) Inventors: Cesar Fernandez Espasa, San Diego, CA (US); Santiago Garcia-Reyero Vinas, San Diego, CA (US); Jose Galmes, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 17 days.

(21) Appl. No.: 14/907,427

(22) PCT Filed: Jul. 31, 2013

(86) PCT No.: PCT/US2013/052982
§ 371 (c)(1),
(2) Date: Jan. 25, 2016

(87) PCT Pub. No.: WO2015/016900
PCT Pub. Date: Feb. 5, 2015

(65) Prior Publication Data
US 2016/0167361 A1 Jun. 16, 2016

(51) Int. Cl.
*B41J 2/21* (2006.01)
*B41J 11/00* (2006.01)
*B41F 33/00* (2006.01)

(52) U.S. Cl.
CPC ..... *B41F 33/00* (2013.01); *B41J 2/2135* (2013.01); *B41J 2/2146* (2013.01); *B41J 11/0095* (2013.01); *B41J 11/002* (2013.01)

(58) Field of Classification Search
CPC .... G01B 11/14; B65H 43/00; B65H 2557/62; B65H 2301/517; B41J 13/0009;
(Continued)

(56) References Cited

U.S. PATENT DOCUMENTS 5,806,430 A 9/1998 Rodi
6,253,678 B1 7/2001 Wentworth
(Continued)

FOREIGN PATENT DOCUMENTS

CN 101508195 8/2009
CN 102401715 4/2012

OTHER PUBLICATIONS

International. Searching Authority. ISA/KR. International Search Report. dated Apr. 28, 2014. Application No. PCT/US2013/052982. Filed date Jul. 31, 2013.
(Continued)

*Primary Examiner* — David H Banh
(74) *Attorney, Agent, or Firm* — Dicke Billig & Czaja PLLC

(57) ABSTRACT

A web press system including a first printbar, a first sensor, a second printbar, a second sensor, and a controller. The first printbar prints first user content on a first side of a web of media. The first sensor senses a pattern on the web of media and provides first sensor data as the first printbar prints the first user content. A second printbar prints second user content on the first side of the web of media. The second sensor senses the pattern on the web of media and provides second sensor data as the second printbar prints the second user content. The controller determines an amount of expansion of the web of media in a direction perpendicular to a web advanced direction based on the first sensor data and the second sensor data and modifies printing performed by the second printbar based on the amount of expansion.

17 Claims, 7 Drawing Sheets

(58) Field of Classification Search
CPC .... B41J 2/2135; B41J 2/2146; B41J 11/0095; B41J 11/002; B41F 33/00
See application file for complete search history.

(56) References Cited

U.S. PATENT DOCUMENTS

| | | | | |
|---|---|---|---|---|
| 8,292,398 | B2 | 10/2012 | Mizes et al. | |
| 8,399,263 | B2 | 3/2013 | Kiuchi et al. | |
| 2001/0047727 | A1 | 12/2001 | Shinichi | |
| 2003/0010236 | A1 | 1/2003 | Clemens | |
| 2007/0283827 | A1 | 12/2007 | Jung et al. | |
| 2009/0009812 | A1 | 1/2009 | Sirringhaus et al. | |
| 2009/0293750 | A1 | 12/2009 | Haenni et al. | |
| 2011/0074860 | A1* | 3/2011 | Saettel | B41J 2/175 347/19 |
| 2011/0316925 | A1 | 12/2011 | Saita | |
| 2012/0113176 | A1 | 5/2012 | Folkins et al. | |
| 2013/0050763 | A1 | 2/2013 | Duke et al. | |
| 2013/0321512 | A1* | 12/2013 | Chen | B41J 29/393 347/19 |
| 2014/0037299 | A1* | 2/2014 | Nakura | G03G 15/607 399/16 |
| 2015/0014918 | A1* | 1/2015 | Piatt | B65H 9/20 271/227 |
| 2015/0015634 | A1* | 1/2015 | Piatt | B41J 29/42 347/16 |
| 2015/0015635 | A1* | 1/2015 | Piatt | G01B 11/14 347/16 |

OTHER PUBLICATIONS

Maharajan. Investigation of the Effect of Swelling and Shrinkage or the Wrinkling Response of Locally Wetted Papers Subjected to Tension with Application to Web-fed Ink-jet Printing. Jul. 24, 2007. http://etd.ohiolink.edu/send-pdf.cgi/Maharajan%20Ranjit%20Kumar.pdf?miami1185295870.

* cited by examiner

MODIFYING PRINTING BASED ON CROSS-WEB DISTORTIONS

BACKGROUND

Printing presses reproduce text and images on a print medium. Typically, a printing press deposits ink on paper to reproduce text and images. Often, printing is carried out in a large-scale industrial process for publishing and transaction printing. One type of printing press is a web press.

Usually, a web press prints on a continuous substrate or web of media, such as a roll of paper. A web press can print on one side or both sides of the web of media. Some web presses include a separate print engine for printing on each side of the web of media.

In a web press system, the web of media, such as paper from a roll of paper, moves through the web press on a series of rollers. One or more print engines deposit printing fluid on the web of media and drying units dry the printing fluid on the web of media. After printing, in post-processing, the web of media is processed into books, papers, maps, pamphlets, magazines, or other suitable formats.

DETAILED DESCRIPTION

Figure 1:
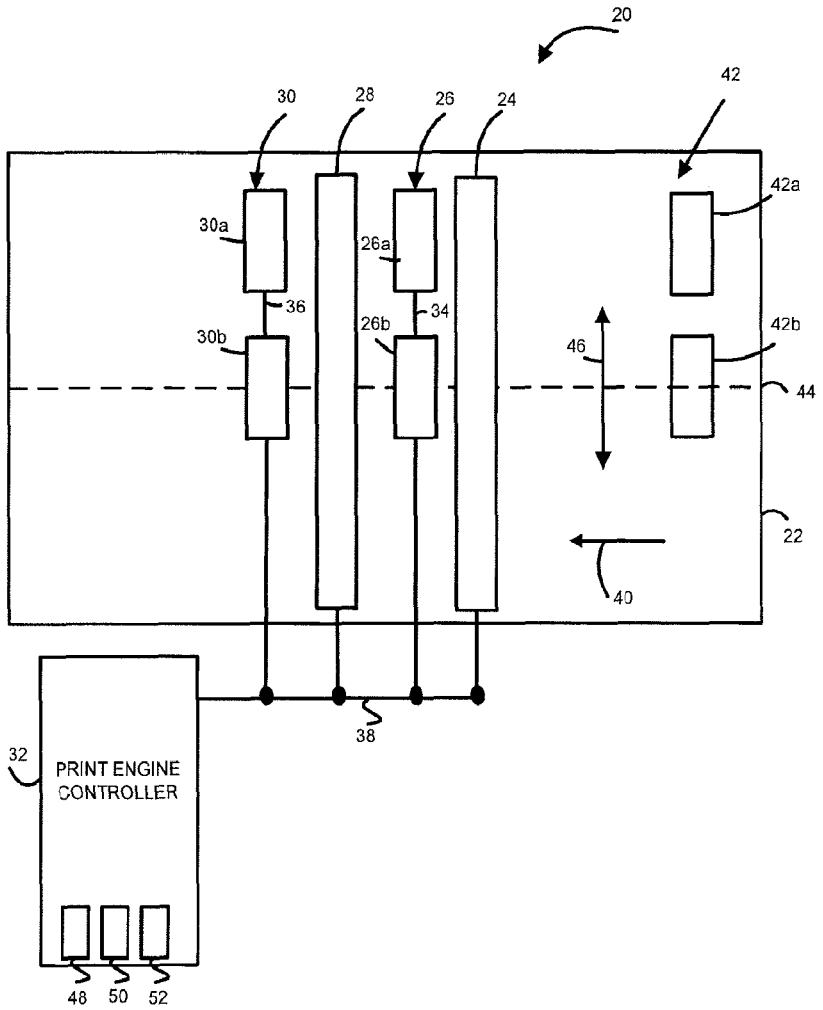
FIG. 1 is a diagram illustrating one example of a web press system that compensates for cross-web expansion and reduces cross-web color to color misalignment.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Some printing presses, including some web presses, employ inkjet technology for depositing printing fluid on a print medium. These inkjet technologies include thermal inkjet printing and piezoelectric inkjet printing. In inkjet printing, the printing fluid is deposited on the media and fluid in the printing fluid is evaporated from the media resulting in dried text and images on the media. Often, the printing fluid is an aqueous based ink that includes water holding ink pigments and the media is paper.

During inkjet printing, the media may expand as the printing fluid is deposited on the media and shrink as the printing fluid and media are dried. Media distortions, such as expansion and contraction of the media, in the cross-web direction, usually, result in a net shrinkage of up to 1%. Thus, a 42 inch (107 centimeter (cm)) wide roll of media, such as a 42 inch wide roll of paper, may shrink about a half inch (1.3 cm) in width.

Media expansion is dependent on the type of media and the type of printing fluid. In situations where the media is paper and the printing fluid is an aqueous based ink, expansion is dependent on the direction of paper fibers and the amount of ink or water) deposited on the paper as well as the paper type and thickness.

Media expansion creates cross-web color to color misalignment. In industrial printers, such as web presses, different ink colors are applied sequentially, one after another, on the media with a delay between applications of different colors. The media expands between applications of different colors, such that the different colors are not aligned with one another, referred to as cross-web color to color misalignment, which reduces image quality.

After depositing the printing fluid on the media, fluid is evaporated from the printing fluid using techniques such as drying. The media shrinks as it is dried, where the settings of the dryers, the amount of fluid deposited on the media, and the media type are factors that influence the amount of shrinkage.

Media shrinkage creates front to back cross-web misregistration and distortions in the absolute width of the printed text and images on the web of media, also referred to as overall absolute dimension problems. In duplex printing systems, side A of the media is printed and dried and then side B of the media is printed and dried. The width of the media shrinks a first time in response to the drying of side A and the width of the media shrinks a second time in response to the drying of side B. Thus, user content on side A of the media shrinks a first time in response to the drying of side A and a second time in response to the drying of side B, and user content on side B shrinks only in response to the drying of side B. This results in different user content widths on side A and side B of the media, referred to as front to back cross-web misregistration.

In another aspect, the resulting absolute width of user content may be narrower than the originally intended width. In some applications, such as map making, accurate dimensions are required and a net shrinkage results in the map scale being distorted, such that distances measured on the map do not reflect real distances.

The present disclosure provides techniques for measuring expansion and shrinkage of the media and compensating for distortions dynamically, i.e., while printing user content on the media. By measuring expansion and shrinkage of the media, systems described in the present disclosure compensate for cross-web color to color misalignment, front to back cross-web misregistration, and absolute dimension distortions, which increases the quality of the printed text and images.

FIG. 1 is a diagram illustrating one example of a web press printing system or a web press system 20 that compensates for cross-web expansion and reduces cross-web color to color misalignment. Web press system 20 measures cross-web expansion of a web of media 22 and modifies printing on the web of media 22 based on the measured cross-web expansion. Web press system 20 measures the cross-web expansion and modifies printing as it continues to print user content text and images on the web of media 22, without slowing down or stopping the printing process.

Web press system 20 includes a first printbar 24, a first sensor 26, a second printbar 28, a second sensor 30, and a print engine controller 32. First sensor 26 includes two narrow field of view sensors, top sensor 26*a* and middle sensor 26*b*, communicatively coupled together via communications path 34. Also, second sensor 30 includes two narrow field of view sensors, top sensor 30*a* and middle sensor 30*b*, communicatively coupled together via communications path 36. First printbar 24, first sensor 26, second printbar 28, and second sensor 30 are each communicatively coupled to controller 32 via communications path 38. In other examples, first sensor 26 includes one wide field of view sensor and/or second sensor 30 includes one wide field of view sensor.

The web of media 22 moves in a web advance direction 40, which is from right to left in FIG. 1 and referred to as moving downstream, through web press system 20. Also, moving from left to right in FIG. 1 is referred to as moving upstream through web press system 20. The web of media 22 moves downstream through web press system 20 and past first printbar 24, first sensor 26, second printbar 28, and then second sensor 30. In one example, the web of media 22 is paper from a roll of paper.

The web of media 22 includes a pattern 42 printed at intervals in the web advance direction 40 on the web of media 22. Pattern 42 includes a top pattern 42*a* and a middle pattern 42*b*. Top pattern 42*a* is situated toward the top of the web of media 22 and middle pattern 42*b* is situated at about the centerline 44 of the web of media 22. In the initial or original position of pattern 42 on the web of media 22, which is the position of pattern 42 on the web of media 22 before passing by first printbar 24, top pattern 42*a* is located a known distance from centerline 44 and middle pattern 42*b* in a direction perpendicular to the web advance direction 40, referred to as the cross-web direction 46. Pattern 42 can be any suitable pattern, such as straight lines that are parallel with the web advance direction 40 or curved lines in the shape of targets. In other examples, pattern 42 can be a single pattern strip that extends from centerline 44 toward the top or bottom of the web of media 22.

Pattern 42 is situated on the same side of the web of media 22 as the user content text and images, and the first and second sensors 26 and 30 are situated on the same side of the web of media 22 as the user content text and images to detect pattern 42. In other examples, pattern 42 is situated on the other side of the web of media 22, opposite the user content text and images, and the first and second sensors 26 and 30 are situated on the other side of the web of media 22, opposite the user content text and images, to detect pattern 42.

Pattern 42 can be either visible to the eye or invisible to the eye. In one example, pattern 42 is provided on the web of media 22 via a marking system (not shown for clarity) that is upstream of first printbar 24. In one example, pattern 42 is printed with infrared ink. In one example, pattern 42 is printed with ultraviolet ink. In other examples, a pattern is printed on the web of media 22 via a printbar, such as printbar 24. In other examples, different types of patterns can be used, such as micro-holes or embossed media.

First printbar 24 includes one or more printheads and each printhead includes one or more printhead chips or die (not shown for clarity). Printing fluid and electrical signals are provided to each of the printhead chips to deposit printing fluid on the web of media 22. In one example, first printbar 24 includes thermal inkjet printhead chips. In one example, first printbar 24 includes piezoelectric inkjet printhead chips.

First printbar 24 deposits printing fluid on the web of media 22 as the web of media 22 moves through web press system 20. First printbar 24 deposits any suitable color of printing fluid on the web of media 22. The web of media 22 expands due to the printing fluid deposited on the web of media 22 by first printbar 24. In one example, first printbar 24 deposits ink on the web of media 22. In one example, first printbar 24 deposits an aqueous based ink on the web of media 22.

First sensor 26 senses pattern 42 on the web of media 22 after expansion of the web of media 22 due to printing fluid deposited on the web of media 22 by first printbar 24. Top sensor 26*a* senses top pattern 42*a* and middle sensor 26*b* senses middle pattern 42*b*. First sensor 26 provides sensor data that indicates the positions of top pattern 42*a* and middle pattern 42*b* in the cross-web direction 46 on the web of media 22. In one example, first sensor 26 is an optical sensor.

Next, as the web of media 22 moves through web press system 20, second printbar 28 deposits printing fluid on the web of media 22. Second printbar 28 includes one or more printheads and each printhead includes one or more printhead chips or die (not shown for clarity). Printing fluid and electrical signals are provided to each of the printhead chips for depositing printing fluid on the web of media 22. In one example, second printbar 28 includes thermal inkjet printhead chips. In one example, second printbar 28 includes piezoelectric inkjet printhead chips.

Second printbar 28 deposits any suitable color of printing fluid on the web of media 22. The web of media 22 expands due to the printing fluid deposited on the web of media 22 by second printbar 28. In one example, second printbar 28 deposits ink on the web of media 22. In one example, second printbar 28 deposits an aqueous based ink on the web of media 22.

Second sensor 30 senses pattern 42 on the web of media 22 after expansion of the web of media 22 due to printing fluid deposited on the web of media 22 by second printbar 28. Top sensor 30*a* senses top pattern 42*a* and middle sensor 30*b* senses middle pattern 42*b*. Second sensor 30 provides sensor data that indicates the position of top pattern 42*a* and middle pattern 42*b* in the cross-web direction 46 on the web of media 22. In one example, second sensor 26 is an optical sensor.

Controller 32 receives sensor data from first sensor 26 and second sensor 30 and determines the amount of expansion of the web of media 22 in the direction perpendicular to the web advance direction, i.e., in the cross-web direction 46, at each of the sensor positions. Controller 32 modifies the printing performed by first printbar 24 and/or second printbar 28 based on the amount of expansion of the web of media 22, which compensates for the measured expansion of the web of media 22 and reduces cross-web color to color misalignment.

In one example, controller 32 determines the amount of expansion of the web of media 22 in the cross-web direction 46 from the distance between pattern 42*a* and pattern 42*b* at first sensor 26 and from the distance between pattern 42*a* and pattern 42*b* at second sensor 30. In one example, controller 32 determines the amount of expansion of the web of media 22 in the cross-web direction 46 from the position of pattern 42 at first sensor 26 compared to the original position of pattern 42. In one example, controller 32 determines the amount of expansion of the web of media 22 in the cross-web direction 46 from the position of pattern 42 at second sensor 30 compared to the original position of pattern 42.

Controller 32 includes hardware and software for determining the amount of expansion of the web of media 22 in the direction perpendicular to the web advance direction and for modifying the printing performed by first printbar 24 and/or second printbar 28 to reduce cross-web color to color misalignment.

In one example, controller 32 includes a processor 48, memory 50, also referred to as machine-readable (or computer-readable) storage media 50, and a network interface 52. The processor 48 is connected to network interface 52 to communicate over a network and the processor 48 is connected to memory 50. The processor 48 can include a microprocessor, a microcontroller, a processor module or subsystem, a programmable integrated circuit, a programmable gate array, and/or another control/computing device. The memory 50 can include different forms of memory including semiconductor memory devices, such as dynamic or static random access memories (DRAMs or SRAMs), erasable and programmable read-only memories (EPROMs), electrically erasable and programmable read-only memories (EEPROMs), and flash memories; magnetic disks such as fixed, floppy, and removable disks; other magnetic media including magnetic tape; optical media such as compact disks (CDs) and digital video disks (DVDs); and other types of storage devices. The techniques of the present disclosure can be implemented on a web press system, such as web press system 20 of FIG. 1, having machine-readable instructions stored in memory 50 and executed on processor 48. The machine-readable instructions can be provided on one computer-readable or machine-readable storage medium 50, or alternatively, can be provided on multiple computer-readable or machine-readable storage media 50 distributed in the web press system at multiple nodes. Such computer-readable or machine-readable storage media 50 is considered to be part of an article or article of manufacture, which can refer to any manufactured single component or multiple components. In one example, memory is located at a remote site from which machine-readable instructions can be downloaded over a network via network interface 52 for execution by processor 48.

By measuring the cross-web expansion of the web of media 22 and modifying the printing of one or more printbars, web press system 20 compensates for the measured cross-web expansion to reduce cross-web color to color misalignment and increase the quality of the printed text and images.

In other examples, web press system 20 includes any suitable number of printbars and sensors. In one example, web press system 20 includes one printbar and one sensor that follows the printbar in the downstream direction. In one example, web press system 20 includes more than two printbars and more than two sensors, such that each of the printbars has a corresponding sensor that follows the printbar in the downstream direction.

Figure 2:
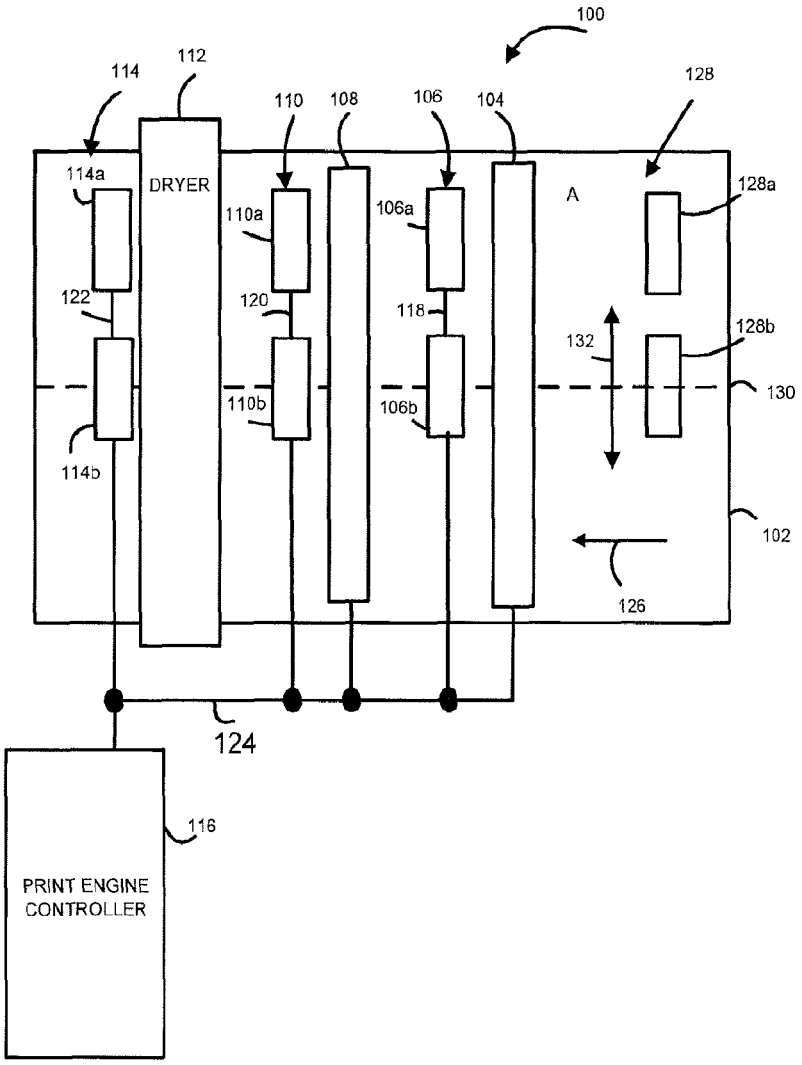
FIG. 2 is a diagram illustrating one example of a web press system that compensates for cross-web expansion and cross-web shrinkage of a web of media, reducing cross-web color to color misalignment and distortion in absolute dimensions of the printed text and images.

FIG. 2 is a diagram illustrating one example of a web press system 100 that compensates for cross-web expansion and cross-web contract on or shrinkage of a web of media 102. Web press system 100 reduces cross-web color to color misalignment and provides cross-web width accuracy of the user content text and images on the web of media 102. Web press system 100 measures cross-web expansion and cross-web shrinkage of the web of media 102 and modifies printing on the web of media 102 based on the measured cross-web expansion and cross-web shrinkage. Web press system 100 measures the cross-web expansion and cross-web shrinkage and modifies printing as it continues to print user content text and images on the web of media 102, without slowing down or stopping the printing process.

Web press system 100 includes a first printbar 104, a first sensor 106, a second printbar 108, a second sensor 110, a dryer 112, a third sensor 114, and a print engine controller 116. First sensor 106 includes two narrow field of view sensors, top sensor 106*a* and middle sensor 106*b*, communicatively coupled together via communications path 118. Second sensor 110 includes two narrow field of view sensors, tap sensor 110*a* and middle sensor 110*b*, communicatively coupled together via communications path 120. Also, third sensor 114 includes two narrow field of view sensors, top sensor 114*a* and middle sensor 114*b*, communicatively coupled together via communications path 122. First printbar 104, first sensor 106, second printbar 108, second sensor 110, and third sensor 114 are each communicatively coupled to controller 116 via communications path 124. In other examples, first sensor 106 includes one wide field of view sensor and/or second sensor 110 includes one wide field of view sensor and/or third sensor 114 includes one wide field of view sensor.

Dryer 112 is communicatively coupled to a web press system controller (not shown) that controls the operation of dryer 112. In other examples, dryer 112 is communicatively coupled to and controlled by controller 116.

The web of media 102 moves in a web advance direction 126, which is from right to left in FIG. 2 and referred to as moving downstream, through web press system 100. Moving from left to right in FIG. 2 is referred to as moving upstream through web press system 100. The web of media 102 travels downstream through web press system 100 past first printbar 104, first sensor 106, second printbar 108, and second sensor 110, then through dryer 112 and past third sensor 114. In one example, the web of media 102 is paper from a roll of paper.

The web of media 102 includes a pattern 128 printed at intervals in the web advance direction 126 on one side of the web of media 102. Pattern 128 includes a top pattern 128*a* and a middle pattern 128*b*. Top pattern 128*a* is situated toward the top of the web of media 102 and middle pattern 128*b* is situated at about the centerline 130 of the web of media 102. In an initial or original position of pattern 128, which is the position of pattern 128 on the web of media 102 before passing by first printbar 104, top pattern 128*a* is located a known distance from centerline 130 and middle pattern 128*b* in a direction perpendicular to the web advance direction 126, referred to as the cross-web direction 132. Pattern 128 can be any suitable pattern, such as straight lines that are parallel with the web advance direction 126 or curved lines in the shape of targets. In other examples, pattern 128 can be a single pattern strip that extends from centerline 130 toward the top or bottom of the web of media 102.

Pattern 128 is situated on the same side of the web of media 102 as the user content text and images. Also, the first, second, and third sensors 106, 110, and 114 are situated on the same side of the web of media 102 as the user content text and images to detect pattern 128. In other examples, pattern 128 is situated on the other side of the web of media 102, opposite the user content text and images, and the first, second, and third sensors 106, 110, and 114 are situated on the other side of the web of media 102, opposite the user content text and images, to detect pattern 128.

Pattern 128 can be either visible to the eye or invisible to the eye. In one example, pattern 128 is provided on the web of media 102 via a marking system (not shown for clarity) that is upstream of first printbar 104. In one example, pattern 128 is printed with infrared ink. In one example, pattern 128 is printed with ultraviolet ink. In other examples, a pattern is printed on the web of media 102 via a printbar, such as printbar 104. In other examples, different types of patterns can be used, such as micro-holes or embossed media.

First printbar 104 includes one or more printheads and each printhead includes one or more printhead chips or die (not shown for clarity). Printing fluid and electrical signals are provided to each of the printhead chips to deposit printing fluid on the web of media 102. In one example, first printbar 104 includes thermal inkjet printhead chips. In one example, first printbar 104 includes piezoelectric inkjet printhead chips.

First printbar 104 deposits printing fluid on the one side of the web of media 102. First printbar 104 deposits any suitable color of printing fluid on the web of media 102. The web of media 102 expands due to the printing fluid deposited by first printbar 104. In one example, first printbar 104 deposits ink on the web of media 102. In one example, first printbar 104 deposits an aqueous based ink on the web of media 102.

First sensor 106 senses pattern 128 after expansion of the web of media 102 due to printing fluid deposited by first printbar 104. Top sensor 106*a* senses top pattern 128*a* and middle sensor 106*b* senses middle pattern 128*b*. First sensor 106 provides sensor data that indicates the positions of top pattern 128*a* and middle pattern 128*b* in the cross-web direction 132 on the web of media 102. In one example, first sensor 106 is an optical sensor.

Next, second printbar 108 deposits printing fluid on the one side of the web of media 102. Second printbar 108 includes one or more printheads and each printhead includes one or more printhead chips or die (not shown for clarity). Printing fluid and electrical signals are provided to each of the printhead chips for depositing printing fluid on the web of media 102. In one example, second printbar 108 includes thermal inkjet printhead chips. In one example, second printbar 108 includes piezoelectric inkjet printhead chips.

Second printbar 108 deposits any suitable color of printing fluid on the web of media 102. The web of media 102 expands due to the printing fluid deposited by second printbar 108. In one example, second printbar 108 deposits ink on the web of media 102. In one example, second printbar 108 deposits an aqueous based ink on the web of media 102.

Second sensor 110 senses pattern 128 after expansion of the web of media 102 due to printing fluid deposited by second printbar 108. Top sensor 110*a* senses top pattern 128*a* and middle sensor 110*b* senses middle pattern 128*b*. Second sensor 110 provides sensor data that indicates the position of top pattern 128*a* and middle pattern 128*b* in the cross-web direction 132 on the web of media 102. In one example, second sensor 110 is an optical sensor.

Next, the web of media 102 moves through dryer 112, which evaporates fluid from the printing fluid and the web of media 102. As dryer 112 dries the printing fluid and the web of media 102, the web of media 102 contracts or shrinks in the cross-web direction 132, where media expansion and shrinkage in the cross-web direction, usually, results in a net shrinkage of the web of media 102.

Third sensor 114 senses pattern 128 after contraction of the web of media 102 due to drying of the printing fluid and the web of media 102. Top sensor 114*a* senses top pattern 128*a* and middle sensor 114*b* senses middle pattern 128*b*. Third sensor 114 provides sensor data that indicates the position of top pattern 128*a* and middle pattern 128*b* in the cross-web direction 132 on the web of media 102. In one example, third sensor 114 is an optical sensor.

Controller 116 receives sensor data from first sensor 106, second sensor 110, and third sensor 114. Controller 116 determines the amount of expansion of the web of media 102 in the cross-web direction 132 and controller 116 determines the amount of shrinkage of the web of media 102 in the cross-web direction 132. The amount of expansion is due to first printbar 104 and second printbar 108 depositing printing fluid on the web of media 102, and the amount of shrinkage is due to dryer 122 drying the printing fluid and the web of media 102.

Controller 116 modifies printing performed by first printbar 104 and/or second printbar 108 on the one side of the web of media 102 based on the amount of expansion of the web of media 102 and the amount of shrinkage of the web of media 102. Controller 116 compensates for the expansion of the web of media 102 to reduce cross-web color to color misalignment, and controller 116 compensates for the net expansion and shrinkage of the web of media to provide cross-web width accuracy of the user content text and images on the web of media 102. In one example, controller 116 determines the amount of expansion of the web of media 102 in the cross-web direction 132 from the distance between pattern 128*a* and pattern 128*b* at first sensor 106, the distance between pattern 128*a* and pattern 128*b* at second sensor 110, and the distance between pattern 128*a* and pattern 128*b* at third sensor 114. In one example, controller 116 determines the amount of expansion of the web of media 102 in the cross-web direction 132 from the position of pattern 128 at first sensor 106 compared to the original position of pattern 128. In one example, controller 116 determines the amount of expansion of the web of media 102 in the cross-web direction 132 from the position of pattern 128 at second sensor 110 compared to the original position of pattern 128. In one example, controller 116 determines the net amount of expansion and shrinkage of the web of media 102 in the cross-web direction 132 from the position of pattern 128 at third sensor 114 compared to the original position of pattern 128.

Controller 116 includes hardware and software for performing the tasks described above. In one example, controller 116 is similar to controller 32 (shown in FIG. 1) and includes a processor, memory, also referred to as machine-readable (or computer-readable) storage media, and a network interface, similar to one example of controller 32.

By measuring the cross-web expansion and shrinkage of the web of media 102 and modifying the printing of one or more printbars, web press system 100 compensates for the measured cross-web expansion and the measured cross-web shrinkage to reduce cross-web color to color misalignment and provide absolute width accuracy of the printed user content, which increases the quality of the printed text and images and the finished product.

In other examples, web press system 100 includes any suitable number of printbars and sensors. In one example, web press system 100 includes more than two printbars and more than three sensors, such that each of the printbars has a corresponding sensor that follows the printbar in the downstream direction.

Figure 3:
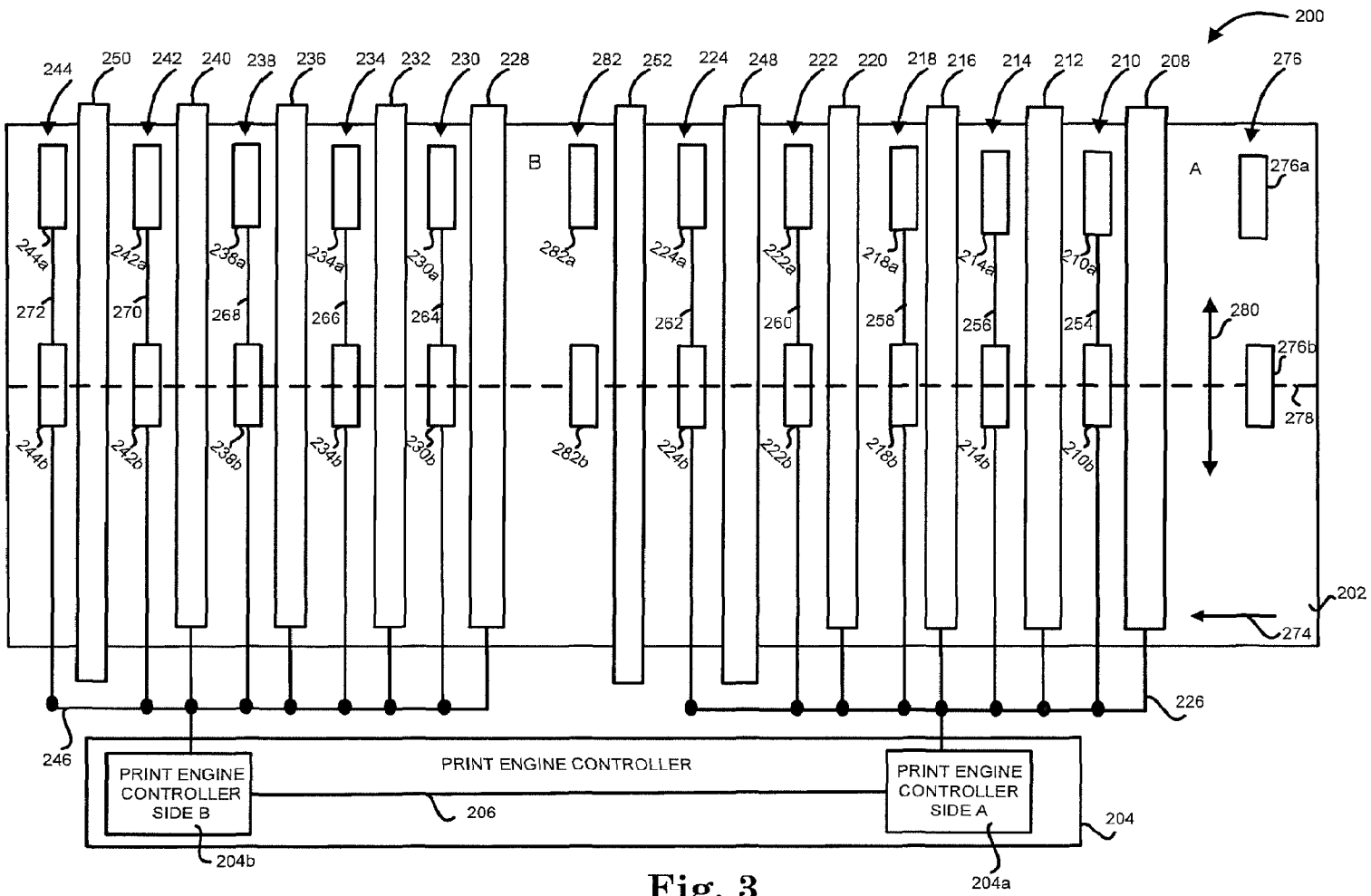
FIG. 3 is a diagram illustrating one example of a duplex web press system that compensates for cross-web expansion and cross-web shrinkage of a web of media, reducing cross-web color to color misalignment, distortion in absolute dimensions of the printed text and images, and front to back misregistration of the printed text and images on the web of media.

FIG. 3 is a diagram illustrating one example of a duplex web press system 200 that compensates for cross-web expansion and cross-web shrinkage of a web of media 202 to reduce distortions in the absolute width of the printed text and images as compared to the originally intended width of the text and images, reduce cross-web color to color misalignment of the printed text and images, and reduce front to back misregistration of the printed text and images. Web press system 200 uses four printbars and a dryer for printing on each side of the web of media 202. In other examples, web press system 200 includes any suitable number of printbars and sensors. In one example, web press system 200 includes less than eight printbars and less than ten sensors. In one example, web press system 200 includes more than eight printbars and more than ten sensors.

Web press system 200 measures cross-web expansion and cross-web shrinkage of the web of media 202 and modifies printing on the web of media 202 based on the measured cross-web expansion and cross-web shrinkage. Web press system 200 measures the cross-web expansion and cross-web shrinkage and modifies printing as it continues to print user content text and images on sides A and B of the web of media 202, without slowing down or stopping the printing process.

Web press system 200 includes a print engine controller 204 that includes a side A print engine controller 204*a* communicatively coupled to a side B print engine controller 204*b* via communications path 206. Side A print engine controller 204*a* controls printing on side A of the web of media 202 and side B print engine controller 204*b* controls printing on side B of the web of media 202.

Web press system 200 includes a first side A printbar 208, a first side A sensor 210, a second side A printbar 212, a second side A sensor 214, a third side A printbar 216, a third side A sensor 218, a fourth side A printbar 220, a fourth side A sensor 222, and a fifth side A sensor 224 each communicatively coupled to side A print engine controller 204*a* via communications path 226. Web press system 200 includes a first side B printbar 228, a first side B sensor 230, a second side B printbar 232, a second side B sensor 234, a third side B printbar 236, a third side B sensor 238, a fourth side B printbar 240, a fourth side B sensor 242, and a fifth side B sensor 244 each communicatively coupled to side B print engine controller 204*b* via communications path 246. In addition, web press system 200 includes a side A dryer 248, a side B dryer 250, and a media turn-over mechanism 252 communicatively coupled to a web press system controller (not shown) that controls the operation of side A dryer 248, side B dryer 250, and media turn-over mechanism 252. In other examples, side A dryer 248 is communicatively coupled to and controlled by controller 204*a*. In other examples, side B dryer 250 is communicatively coupled to and controlled by controller 204*b*. In other examples, media turn-over mechanism 252 is communicatively coupled to and controlled by controller 204*a* or 204*b*.

Each of the sensors includes two narrow field of view sensors. First side A sensor 210 includes top sensor 210*a* and middle sensor 210*b* communicatively coupled together via communications path 254. Second side A sensor 214 includes top sensor 214*a* and middle sensor 214*b* communicatively coupled together via communications path 256. Third side A sensor 218 includes top sensor 218*a* and middle sensor 218*b* communicatively coupled together via communications path 258. Fourth side A sensor 222 includes top sensor 222*a* and middle sensor 222*b* communicatively coupled together via communications path 260. Fifth side A sensor 224 includes top sensor 224*a* and middle sensor 224*b* communicatively coupled together via communications path 262. First side B sensor 230 includes top sensor 230*a* and middle sensor 230*b* communicatively coupled together via communications path 264. Second side B sensor 234 includes top sensor 234*a* and middle sensor 234*b* communicatively coupled together via communications path 266. Third side B sensor 238 includes top sensor 238*a* and middle sensor 238*b* communicatively coupled together via communications path 268. Fourth side B sensor 242 includes top sensor 242*a* and middle sensor 242*b* communicatively coupled together via communications path 270. Fifth side B sensor 244 includes top sensor 244*a* and middle sensor 244*b* communicatively coupled together via communications path 272. In other examples, each of the sensors can include one wide field of view sensor.

The web of media 202 moves in a web advance direction 274, which is from right to left in FIG. 3 and referred to as moving downstream, through web press system 200. Moving from left to right in FIG. 3 is referred to as moving upstream in web press system 200. The web of media 202 travels downstream through web press system 200 past first side A printbar 208, first side A sensor 210, second side A printbar 212, second side A sensor 214, third side A printbar 216, third side A sensor 218, fourth side A printbar 220, and fourth side A sensor 222, then through side A dryer 248 and past fifth side A sensor 224, and then through media turn-over mechanism 252. Next, the web of media 202 travels past first side B printbar 228, first side B sensor 230, second side B printbar 232, second side B sensor 234, third side B printbar 236, third side B sensor 238, fourth side B printbar 240, and fourth side B sensor 242, and then through side B dryer 250 and past fifth side B sensor 244. In one example, the web of media 202 is paper from a roll of paper.

The web of media 202 includes a side A pattern 276 printed at intervals in the web advance direction 274 on side A of the web of media 202. Side A pattern 276 includes a top pattern 276*a* and a middle pattern 276*b*. Top pattern 276*a* is situated toward the top of side A of the web of media 202 and middle pattern 276*b* is situated at about the centerline 278 of the web of media 202. In an original position of side A pattern 276, which is the position of side A pattern 276 on the web of media 202 before passing by first side A printbar 208, top pattern 276*a* is located a known distance from centerline 278 and middle pattern 276*b* in a direction perpendicular to the web advance direction 274, referred to as the cross-web direction 280. Side A pattern 276 can be any suitable pattern, such as straight lines that are parallel with the web advance direction 274 or curved lines in the shape of targets. In other examples, side A pattern 276 can be a single pattern strip that extends from centerline 278 toward the top or bottom of the web of media 202.

Side A pattern 276 and side A user content and images are situated on side A of the web of media 202. Also, the first, second, third, fourth and fifth side A sensors 210, 214, 218, 222, and 224 are situated on side A of the web of media 202 to detect side A pattern 276. In other examples, side A pattern 276 is situated on side B of the web of media 202, opposite the side A user content text and images, and the first, second, third, fourth and fifth side A sensors 210, 214, 218, 222, and 224 are situated on side B of the web of media 202, opposite the side A user content text and images, to detect side A pattern 276.

Side A pattern 276 can be either visible to the eye or invisible to the eye. In one example, side A pattern 276 is provided on the web of media 202 via a marking system (not shown for clarity) that is upstream of first side A printbar 208. In one example, side A pattern 276 is printed with infrared ink. In one example, side A pattern 276 is printed with ultraviolet ink. In other examples, a side A pattern is printed on the web of media 202 via a printbar, such as printbar 208. In other examples, different types of patterns can be used, such as micro-holes or embossed media.

The web of media 202 also includes a side B pattern 282 printed at intervals in the web advance direction 274 on side B of the web of media 202. Side B pattern 282 includes a top pattern 282*a* and a middle pattern 282*b*. Top pattern 282*a* is situated toward the top of side B of the web of media 202 and middle pattern 282*b* is situated at about the centerline 278 of the web of media 202. In an original position of side B pattern 282, which is the position of side B pattern 282 on the web of media 202 before passing by first side B printbar 228, top pattern 282*a* is located a known distance from centerline 278 and middle pattern 282*b* in the direction perpendicular to the web advance direction 274, referred to as the cross-web direction 280. Side B pattern 282 can be any suitable pattern, such as straight lines that are parallel with the web advance direction 274 or curved lines in the shape of targets. In other examples, side B pattern 282 can be a single pattern strip that extends from centerline 278 toward the top or bottom of the web of media 202.

Side B pattern 282 and side B user content and images are situated on side B of the web of media 202. Also, the first, second, third, fourth and fifth side B sensors 230, 234, 238, 242, and 244 are situated on side B of the web of media 202 to detect side B pattern 282. In other examples, side B pattern 282 is situated on side A of the web of media 202, opposite the side B user content text and images, and the first, second, third, fourth and fifth side B sensors 230, 234, 238, 242, and 244 are situated on side A of the web of media 202, opposite the side B user content text and images, to detect side B pattern 282.

Side B pattern 282 can be either visible to the eye or invisible to the eye. In one example, side B pattern 282 is provided on the web of media 202 via a marking system (not shown for clarity) that is upstream of first side B printbar 228. In one example, side B pattern 282 is printed with infrared ink. In one example, side B pattern 282 is printed with ultraviolet ink. In other examples, a side B pattern is printed on the web of media 202 via a printbar, such as printbar 228. In other examples, different types of patterns can be used, such as micro-holes or embossed media.

Each of the side A printbars and each of the side B printbars includes one or more printheads and each printhead includes one or more printhead chips or die (not shown for clarity). Printing fluid and electrical signals are provided to each of the printhead chips to deposit printing fluid on the web of media 202. In one example, one or more of the printbars includes thermal inkjet printhead chips. In one example, one or more of the printbars includes piezoelectric inkjet printhead chips.

First side A printbar 208 deposits printing fluid on side A of the web of media 202. First side A printbar 208 deposits printing fluid, such as bonding agent or colored ink. The web of media 202 expands due to the printing fluid deposited on side A by first side A printbar 208. In one example, first side A printbar 208 deposits ink on side A of the web of media 202. In one example, first side A printbar 208 deposits an aqueous based ink on side A of the web of media 202. In one example, first side A printbar 208 deposits a black, cyan, magenta, or yellow ink on side A of the web of media 202.

First side A sensor 210 senses side A pattern 276 after expansion of the web of media 202 due to printing fluid deposited by first side A printbar 208. Top sensor 210*a* senses top pattern 276*a* and middle sensor 210*b* senses middle pattern 276*b*. First side A sensor 210 provides sensor data that indicates the positions of top pattern 276*a* and middle pattern 276*b* in the cross-web direction 280 on the web of media 202. In one example, first side A sensor 210 is an optical sensor.

Next, second side A printbar 212 deposits printing fluid on side A of the web of media 202. Second side A printbar 212 deposits printing fluid, such as bonding agent or colored ink. The web of media 202 expands due to the printing fluid deposited on side A by second side A printbar 212. In one example, second side A printbar 212 deposits ink on side A of the web of media 202. In one example, second side A printbar 212 deposits an aqueous based ink on side A of the web of media 202. In one example, second side A printbar 212 deposits a black, cyan, magenta, or yellow ink on side A of the web of media 202.

Second side A sensor 214 senses side A pattern 276 after expansion of the web of media 202 due to printing fluid deposited by second side A printbar 212. Top sensor 214*a* senses top pattern 276*a* and middle sensor 214*b* senses middle pattern 276*b*. Second side A sensor 214 provides sensor data that indicates the positions of top pattern 276*a* and middle pattern 276*b* in the cross-web direction 280 on the web of media 202. In one example, second side A sensor 214 is an optical sensor.

Next, third side A printbar 216 deposits printing fluid on side A of the web of media 202. Third side A printbar 216 deposits printing fluid, such as bonding agent or colored ink. The web of media 202 expands due to the printing fluid deposited on side A by third side A printbar 216. In one example, third side A printbar 216 deposits ink on side A of the web of media 202. In one example, third side A printbar 216 deposits an aqueous based ink on side A of the web of media 202. In one example, third side A printbar 216 deposits a black, cyan, magenta, or yellow ink on side A of the web of media 202.

Third side A sensor 218 senses side A pattern 276 after expansion of the web of media 202 due to printing fluid deposited by third side A printbar 216. Top sensor 218*a* senses top pattern 276*a* and middle sensor 218*b* senses middle pattern 276*b*. Third side A sensor 218 provides sensor data that indicates the positions of top pattern 276*a* and middle pattern 276*b* in the cross-web direction 280 on the web of media 202. In one example, third side A sensor 218 is an optical sensor.

Next, fourth side A printbar 220 deposits printing fluid on side A of the web of media 202. Fourth side A printbar 220 deposits printing fluid, such as bonding agent or colored ink. The web of media 202 expands due to the printing fluid deposited on side A by fourth side A printbar 220. In one example, fourth side A printbar 220 deposits ink on side A of the web of media 202. In one example, fourth side A printbar 220 deposits an aqueous based ink on side A of the web of media 202. In one example, fourth side A printbar 220 deposits a black, cyan, magenta, or yellow ink on side A of the web of media 202.

Fourth side A sensor 222 senses side A pattern 276 after expansion of the web of media 202 due to printing fluid deposited by fourth side A printbar 220. Top sensor 222*a* senses top pattern 276*a* and middle sensor 222*b* senses middle pattern 276*b*. Fourth side A sensor 222 provides sensor data that indicates the positions of top pattern 276*a* and middle pattern 276*b* in the cross-web direction 280 on the web of media 202. In one example, fourth side A sensor 222 is an optical sensor.

Next, the web of media 202 moves through side A dryer 248, which evaporates fluid from the printing fluid and the web of media 202. As side A dryer 248 dries the printing fluid and the web of media 202, the web of media 202 shrinks in the cross-web direction 280, where media expansion and shrinkage in the cross-web direction, usually, results in a net shrinkage of the web of media 202.

Fifth side A sensor 224 senses side A pattern 276 after shrinkage of the web of media 202 due to drying of the printing fluid and the web of media 202. Top sensor 224*a* senses top pattern 276*a* and middle sensor 224*b* senses middle pattern 276*b*. Fifth side A sensor 224 provides sensor data that indicates the position of top pattern 276*a* and middle pattern 276*b* in the cross-web direction 280 on the web of media 202. In one example, fifth side A sensor 224 is an optical sensor.

Next, the web of media 202 travels through media turnover mechanism 252 that turns the web of media 202 over for printing on side B of the web of media 202.

Next, first side B printbar 228 deposits printing fluid on side B of the web of media 202. First side B printbar 228 deposits printing fluid, such as bonding agent or colored ink. The web of media 202 expands due to the printing fluid deposited on side B by first side B printbar 228. In one example, first side B printbar 228 deposits ink on side B of the web of media 202. In one example, first side B printbar 228 deposits an aqueous based ink on side B of the web of media 202. In one example, first side B printbar 228 deposits a black, cyan, magenta, or yellow ink on side B of the web of media 202.

First side B sensor 230 senses side B pattern 282 after expansion of the web of media 202 due to printing fluid deposited by first side B printbar 228. Top sensor 230*a* senses top pattern 282*a* and middle sensor 230*b* senses middle pattern 282*b*. First side B sensor 230 provides sensor data that indicates the positions of top pattern 282*a* and middle pattern 282*b* in the cross-web direction 280 on the web of media 202. In one example, first side B sensor 230 is an optical sensor.

Next, second side B printbar 232 deposits printing fluid on side B of the web of media 202. Second side B printbar 232 deposits printing fluid, such as bonding agent or colored ink. The web of media 202 expands due to the printing fluid deposited on side B by second side B printbar 232. In one example, second side B printbar 232 deposits ink on side B of the web of media 202. In one example, second side B printbar 232 deposits an aqueous based ink on side B of the web of media 202. In one example, second side B printbar 232 deposits a black, cyan, magenta, or yellow ink on side B of the web of media 202.

Second side B sensor 234 senses side B pattern 282 after expansion of the web of media 202 due to printing fluid deposited by second side B printbar 232. Top sensor 234*a* senses top pattern 282*a* and middle sensor 234*b* senses middle pattern 282*b*. Second side B sensor 234 provides sensor data that indicates the positions of top pattern 282*a* and middle pattern 282*b* in the cross-web direction 280 on the web of media 202. In one example, second side B sensor 234 is an optical sensor.

Next, third side B printbar 236 deposits printing fluid on side B of the web of media 202. Third side B printbar 236 deposits printing fluid, such as bonding agent or colored ink. The web of media 202 expands due to the printing fluid deposited on side B by third side B printbar 236. In one example, third side B printbar 236 deposits ink on side B of the web of media 202. In one example, third side B printbar 236 deposits an aqueous based ink on side B of the web of media 202. In one example, third side B printbar 236 deposits a black, cyan, magenta, or yellow ink on side B of the web of media 202.

Third side B sensor 238 senses side B pattern 282 after expansion of the web of media 202 due to printing fluid deposited by third side B printbar 236. Top sensor 238*a* senses top pattern 282*a* and middle sensor 238*b* senses middle pattern 282*b*. Third side B sensor 238 provides sensor data that indicates the positions of top pattern 282*a* and middle pattern 282*b* in the cross-web direction 280 on the web of media 202. In one example, third side B sensor 238 is an optical sensor.

Next, fourth side B printbar 240 deposits printing fluid on side B of the web of media 202. Fourth side B printbar 240 deposits printing fluid, such as bonding agent or colored ink. The web of media 202 expands due to the printing fluid deposited on side B by fourth side B printbar 240. In one example, fourth side B printbar 240 deposits ink on side B of the web of media 202. In one example, fourth side B printbar 240 deposits an aqueous based ink on side B of the web of media 202. In one example, fourth side B printbar 240 deposits a black, cyan, magenta, or yellow ink on side B of the web of media 202.

Fourth side B sensor 242 senses side B pattern 282 after expansion of the web of media 202 due to printing fluid deposited by fourth side B printbar 240. Top sensor 242*a* senses top pattern 282*a* and middle sensor 242*b* senses middle pattern 282*b*. Fourth side B sensor 242 provides sensor data that indicates the positions of top pattern 282*a* and middle pattern 282*b* in the cross-web direction 280 on the web of media 202. In one example, fourth side B sensor 242 is an optical sensor.

Next, the web of media 202 moves through side B dryer 250, which evaporates fluid from the printing fluid and the web of media 202. As side B dryer 250 dries the printing fluid and the web of media 202, the web of media 202 shrinks in the cross-web direction 280, where media expansion and shrinkage in the cross-web direction, usually, results in a net shrinkage of the web of media 202.

Fifth side B sensor 244 senses side B pattern 282 after shrinkage of the web of media 202 due to drying of the printing fluid and the web of media 202. Top sensor 244*a* senses top pattern 282*a* and middle sensor 244*b* senses middle pattern 282*b*. Fifth side B sensor 244 provides sensor data that indicates the position of top pattern 282*a* and middle pattern 282*b* in the cross-web direction 280 on the web of media 202. In one example, fifth side B sensor 244 is an optical sensor.

Side A print engine controller 204*a* receives sensor data from first side A sensor 210, second side A sensor 214, third side A sensor 218, fourth side A sensor 222, and fifth side A sensor 224. Side A print engine controller 204*a* determines the amount of expansion of the web of media 202 in the cross-web direction 280. The amount of expansion is due to first side A printbar 208, second side A printbar 212, third side A printbar 216, and fourth side A print bar 220 depositing printing fluid on side A of the web of media 202.

In one example, side A print engine controller 204*a* determines the amount of expansion of the web of media 202 in the cross-web direction 280 due to each of the side A printbars 208, 212, 216, and 220. Side A print engine controller 204*a* determines the amount of expansion between the original position of side A pattern 276 and its position at first side A sensor 210 due to first side A printbar 208, the amount of expansion between the position of side A pattern 276 at first side A sensor 210 and at second side A sensor 214 due to second side A printbar 212, the amount of expansion between the position of side A pattern 276 at second side A sensor 214 and at third side A sensor 218 due to third side A printbar 216, and the amount of expansion between the position of side A pattern 276 at third side A sensor 218 and at fourth side A sensor 222 due to fourth side A print bar 220. By measuring the expansion due to each of the side A printbars 208, 212, 216, and 220, an independent correction factor can be applied to each of the side A printbars 208, 212, 216, and 220 to improve cross-web color to color misalignment. In other examples, side A print engine controller 204*a* determines the amount of expansion of the web of media 202 in the cross-web direction 280 from the position of side A pattern 276 at each of the side A sensors 210, 214, 218, and 222 compared to the original position of side A pattern 276. In other examples, side A print engine controller 204*a* determines the amount of expansion of the web of media 202 in the cross-web direction 280 using fewer sensors and extrapolates correction factors, such as by using an average expansion rate between side A printbars 208, 212, 216, and 220.

Side A print engine controller 204*a* also determines the amount of shrinkage of the web of media 202 in the cross-web direction 280 due to side A dryer 248. In one example, side A print engine controller 204*a* determines the net amount of expansion and shrinkage due to side A printbars 208, 212, 216, and 220 and side A dryer 248 from the position of side A pattern 276 at fifth side A sensor 224 compared to the original position of side A pattern 276.

Side B print engine controller 204*b* receives sensor data from first side B sensor 230, second side B sensor 234, third side B sensor 238, fourth side B sensor 242, and fifth side B sensor 244. Side B print engine controller 204*b* determines the amount of expansion of the web of media 202 in the cross-web direction 280. The amount of expansion is due to first side B printbar 228, second side B printbar 232, third side B printbar 236, and fourth side B print bar 240 depositing printing fluid on side B of the web of media 202.

In one example, side B print engine controller 204*b* determines the amount of expansion of the web of media 202 in the cross-web direction 280 due to each of the side B printbars 228, 232, 236, and 240. Side B print engine controller 204*b* determines the amount of expansion between the original position of side B pattern 282 and its position at first side B sensor 230 due to first side B printbar 228, the amount of expansion between the position of side B pattern 282 at first side B sensor 230 and at second side B sensor 234 due to second side B printbar 232, the amount of expansion between the position of side B pattern 282 at second side B sensor 234 and at third side B sensor 238 due to third side B printbar 236, and the amount of expansion between the position of side B pattern 282 at third side B sensor 238 and at fourth side B sensor 242 due to fourth side B print bar 240. By measuring the expansion due to each of the side B printbars 228, 232, 236, and 240, an independent correction factor can be applied to each of the side B printbars 228, 232, 236, and 240 to improve cross-web color to color misalignment on side B of the web of media 202. In other examples, side B pint engine controller 204*b* determines the amount of expansion of the web of media 202 in the cross-web direction 280 from the position of side B pattern 282 at each of the side B sensors 230, 234, 238, and 242 compared to the original position of side B pattern 282. In other examples, side B print engine controller 204*b* determines the amount of expansion of the web of media 202 in the cross-web direction 280 using fewer sensors and extrapolates correction factors, such as by using an average expansion rate between side B printbars 228, 232, 236, and 240.

Side B print engine controller 204*b* also determines the amount of shrinkage of the web of media 202 in the cross-web direction 280 due to side B dryer 250. Side B print engine controller 204*b* provides the side B sensor data and/or the amount of expansion and shrinkage due to side B printbars 228, 232, 236, and 240 and side B dryer 260 to side A print engine controller 204*a*. In one example, side B print engine controller 204*b* determines the net amount of expansion and shrinkage due to side B printbars 228, 232, 236, and 240 and side B dryer 250 from the position of side B pattern 282 at fifth side B sensor 244 compared to the original position of side B pattern 282.

Side A print engine controller 204*a* modifies printing performed by first side A printbar 208, second side A printbar 212, third side A printbar 216, and fourth side A printbar 220 on side A of the web of media 202 based on the amount of expansion and shrinkage of the web of media 202 due to side A printbars 208, 212, 216, and 220 and side A dryer 248 and based on the received data from side B print engine controller 204*b*, which indicates the amount of expansion and shrinkage due to side B printbars 228, 232, 236, and 240 and side B dryer 250. Side A print engine controller 204*a* compensates for the expansion of the web of media 202 due to side A printbars 208, 212, 216, and 220 to reduce cross-web color to color misalignment on side A of the web of media 202 and side A print engine controller 204*a* compensates for expansion and shrinkage due to both side A and side B components to provide absolute width accuracy of the user content text and images printed on side A of the web of media 202.

Side B print engine controller 200 modifies printing performed by first side B printbar 228, second side B printbar 232, third side B printer 236, and fourth side B print bar 240 on side B of the web of media 202 based on the amount of expansion and shrinkage of the web of media 202 due to side B printbars 228, 232, 236, and 240 and side B dryer 250. Side B print engine controller 204*b* compensates for the expansion of the web of media 202 due to side B printbars 228, 232, 236, and 240 to reduce cross-web color to color misalignment on side B of the web of media 202, and side B print engine controller 204*b* compensates for expansion and shrinkage due to side B printbars 228, 232, 236, and 240 and side B dryer 250 to provide absolute width accuracy of the user content text and images printed on side B of the web of media 202. Since side A print engine controller 204*a* provides absolute width accuracy and side B print engine controller 204*b* provides absolute width accuracy, front to back (side A to side B) cross-web misregistration is reduced or eliminated. In other examples, side B print engine controller 204*b* receives and uses side A sensor data and/or the amount of expansion and shrinkage due to side A printbars 208, 212, 216, and 220 and side A dryer 248 from side A print engine controller 204*a*.

Each of the controllers 204*a* and 204*b* includes hardware and software for performing the tasks described above. In one example, each of the controllers 204*a* and 204*b* is similar to controller 32 (shown in FIG. 1) and includes a processor, memory, also referred to as machine-readable (or computer-readable) storage media, and a network interface, similar to one example of controller 32.

The present disclosure provides techniques for measuring expansion and shrinkage of the media and compensating for distortions dynamically, i.e., while printing user content on the media. The techniques include closed loop schemes to adapt to dynamic changes within a print job and maintain consistent print quality throughout a run. By measuring expansion and shrinkage of the media, the techniques of the present disclosure improve cross-web color to color misalignment due to media cross-web expansion, front to back cross-web misregistration to match the width of user content on side A with the width of user content on side B, and absolute dimension distortion, where final user content width is made equal to width of the original text and images, all of which increase the quality of the printed text and images. In addition, the techniques of the present disclosure reduce down-time and paper waste by avoiding trial and error testing and by avoiding re-ripping the print job due to incorrectly guessed correction factors, ink coverage, and/or dryer settings.

Figure 4:
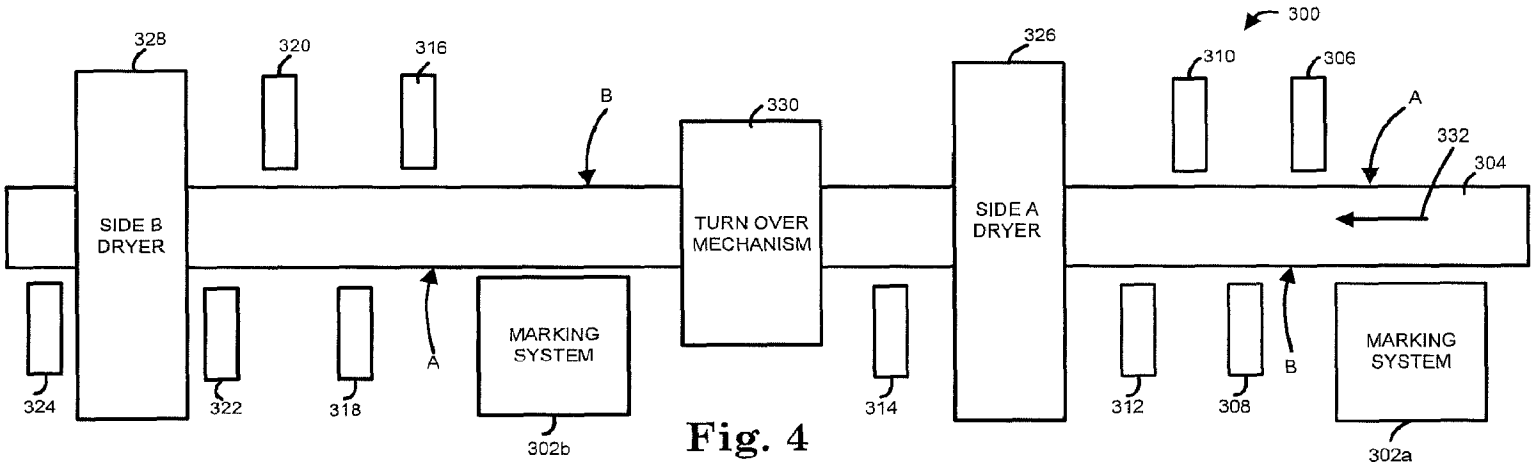
FIG. 4 is a diagram illustrating one example of a web press system that includes two marking systems.

FIG. 4 is a diagram illustrating one example of a web press system 300 that includes two marking systems 302*a* and 302*b*. First marking system 302*a* provides a first pattern, such as pattern 276 (shown in FIG. 3), for determining the expansion and shrinkage due to printing on side A of the web of media 304. Second marking system 302*b* provides a second pattern, such as pattern 282 (shown in FIG. 3), for determining the expansion and shrinkage due to printing on side B of the web of media 304.

Web press system 300 includes a first side A printbar 306, a first side A sensor 308, a second side A printbar 310, a second side A sensor 312, and a third side A sensor 314 communicatively coupled to a side A print engine controller (not shown). Web press system 300 also includes a first side printbar 316, a first side B sensor 318, a second side B printbar 320, a second side B sensor 322, and a third side B sensor 324 communicatively coupled to a side B print engine controller (not shown). In addition, web press system 300 includes a side A dryer 326, a side B dryer 328, and a turn-over mechanism 330 communicatively coupled to a web press system controller (not shown) that controls the operation of side A dryer 326, side B dryer 328, and media turn-over mechanism 330. In other examples, side A dryer 326 is communicatively coupled to and controlled by the side A print engine controller. In other examples, side B dryer 328 is communicatively coupled to and controlled by the side B print engine controller. In other examples, media turn-over mechanism 330 is communicatively coupled to and controlled by the side A or the side B print engine controller.

Web press system 300 is similar to web press system 200 of FIG. 3. Each of the side A printbars 306 and 310 and each of the side B printbars 316 and 320 is similar to one of the printbars shown in FIG. 3, such as printbar 208. Also, each of the side A sensors 308, 312, and 314 and each of the side B sensors 318, 322, and 324 is similar to one of the sensors shown in FIG. 3, such as sensor 210. In addition, side A dryer 326 is similar to side A dryer 248, side B dryer 328 is similar to side B dryer 250, and turn-over mechanism 330 is similar to turn-over mechanism 252 shown in FIG. 3. The web of media 304 moves through web press system 300 in media direction 332.

Web press system 300 operates similar to web press system 200 to measure cross-web expansion and cross-web shrinkage of the web of media 304 and modify printing on the web of media 304 based on the measured cross-web expansion and cross-web shrinkage of the web of media 304.

The differences between web press system 300 and web press system 200 are the positioning of the first pattern and side A sensors 308, 312, and 314 on side B of the web of media for determining the expansion and shrinkage due to printing on side A of the web of media 304, and the positioning of the second pattern and side B sensors 318, 322, and 324 on side A of the web of media for determining the expansion and shrinkage due to printing on side B of the web of media 304.

Figure 5:
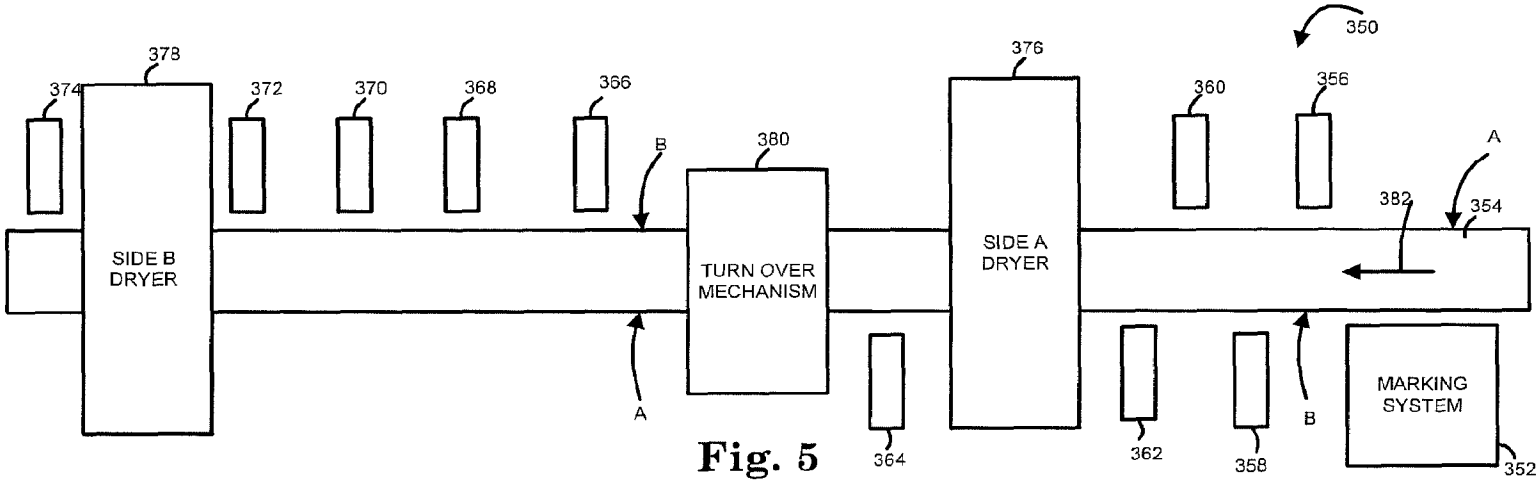
FIG. 5 is a diagram illustrating one example of a web press system that includes one marking system.

FIG. 5 is a diagram illustrating one example of a web press system 350 that includes one marking system 352 that provides a pattern, such as pattern 276 (shown in FIG. 3), for determining the expansion and shrinkage due to printing on side A of the web of media 354 and for determining the expansion and shrinkage due to printing on side B of the web of media 354.

Web press system 350 includes a first side A printbar 356, a first side A sensor 358, a second side A printbar 360, a second side A sensor 362, and a third side A sensor 364 communicatively coupled to a side A print engine controller (not shown). Web press system 350 also includes a first side B printbar 366, a first side B sensor 368, a second side B printbar 370, a second side B sensor 372, and a third side B sensor 374 communicatively coupled to a side B print engine controller (not shown). In addition, web press system 350 includes a side A dryer 376, a side B dryer 378, and a turn-over mechanism 380 communicatively coupled to a web press system controller (not shown) that controls the operation of side A dryer 376, side B dryer 378, and media turn-over mechanism 380. In other examples, side A dryer 376 is communicatively coupled to and controlled by the side A print engine controller. In other examples, side B dryer 378 is communicatively coupled to and controlled by the side B print engine controller. In other examples, media turn-over mechanism 330 is communicatively coupled to and controlled by the side A or the side B print engine controller.

Web press system 350 is similar to web press system 200 of FIG. 3. Each of the side A printbars 356 and 360 and each of the side B printbars 366 and 370 is similar to one of the printbars shown in FIG. 3, such as printbar 208. Also, each of the side A sensors 358, 362, and 364 and each of the side B sensors 368, 372, and 374 is similar to one of the sensors shown in FIG. 3, such as sensor 210. In addition, side A dryer 376 is similar to side A dryer 248, side B dryer 378 is similar to side B dryer 250, and turn-over mechanism 380 is similar to turn-over mechanism 252 shown in FIG. 3. The web of media 354 moves through web press system 350 in media direction 382.

Web press system 350 operates similar to web press system 200 to measure cross-web expansion and cross-web shrinkage of the web of media 354 and modify printing on the web of media 354 based on the measured cross-web expansion and cross-web shrinkage of the web of media 354.

One difference between web press system 350 and web press system 200 is that web press system 350 includes one marking system 352 for providing only one pattern on the web of media 354. This one pattern is detected by the side A sensors 358, 362, and 364 and the side B sensors 368, 372, and 374 to determine the expansion and shrinkage due to printing on side A of the web of media 354 and to determine the expansion and shrinkage due to printing on side B of the web of media 354. Another difference is the placement of side A sensors 358, 362, and 364 on side B of the web of media 354 for determining the expansion and shrinkage due to printing on side A of the web of media 354.

Figure 6:
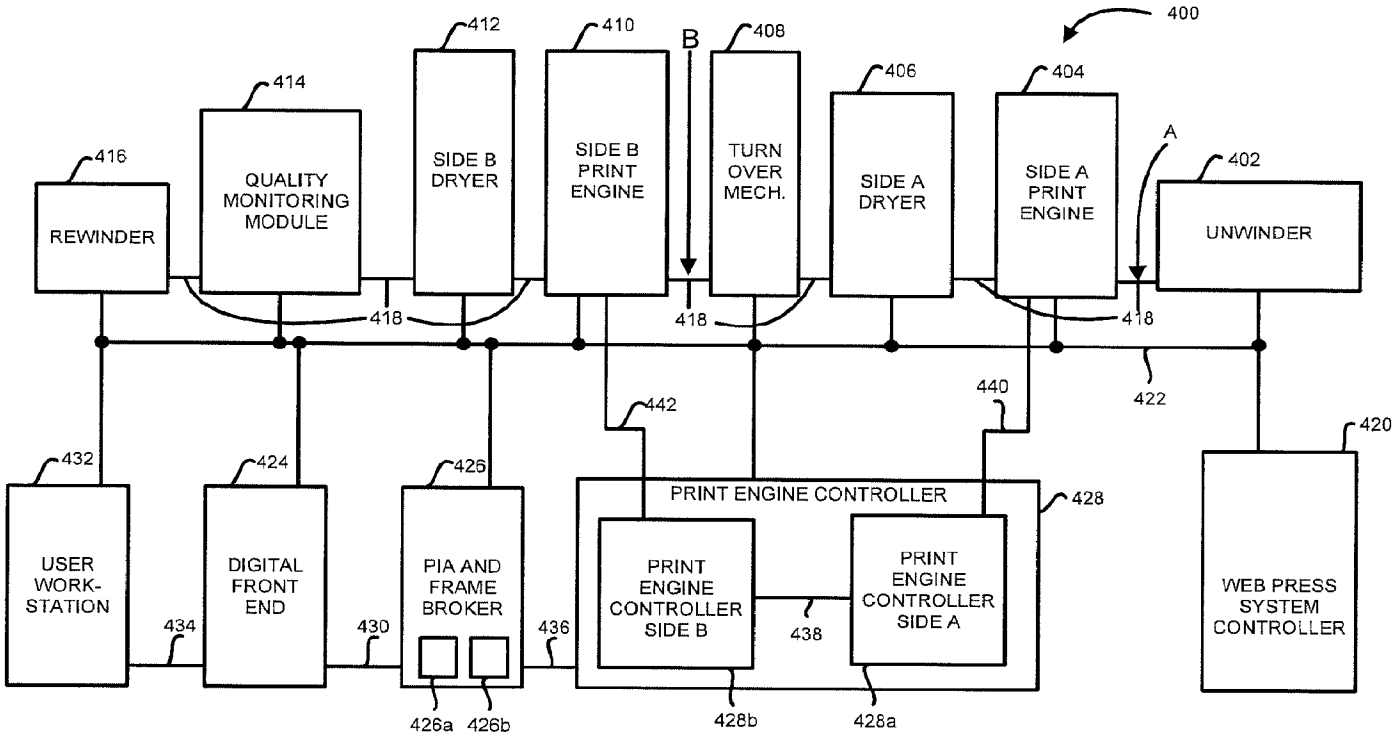
FIG. 6 is a diagram illustrating one example b press system that provides duplex printing.

FIG. 6 is a diagram illustrating one example of a web press system 400 that provides duplex printing, i.e., printing on sides A and B of a web of media. In one example, web press system 400 is similar to web press system 20 of FIG.

1. In one example, web press system 400 is similar to web press system 100 of FIG. 2. In one example, web press system 400 is similar to web press system 200 of FIG. 3. In one example, web press system 400 is similar to web press system 300 of FIG. 4. In one example, web press system 400 is similar to web press system 350 of FIG. 5.

Web press system 400 includes a web of media unwinder 402, a side A print engine 404, a side A dryer 406, a media turn-over mechanism 408, a side B print engine 410, a side B dryer 412, a quality monitoring module 414, and a rewinder 416. Side A print engine 404 and side B print engine 410 include printbars. In one example, side A print engine 404 includes printbars 24 and 104 (shown in FIG. 1). In one example, side A print engine 404 includes printbars 104 and 108 (shown in FIG. 2). In one example, side A print engine 404 includes printbars 208, 212, 216, and 220 (shown in FIG. 3). In one example, side B print engine 410 includes printbars 228, 232, 236, and 240 (shown in FIG. 3). In one example, side A and side B print engines 404 and 410 include printbars shown in FIG. 4. In one example, side A and side B print engines 404 and 410 include printbars shown in FIG. 5.

The web of media 418 unwinds from unwinder 402 and travels downstream, from right to left in FIG. 6, in web press system 400.

Side A print engine 404 deposits printing fluid on side A of the web of media 418 to print user content text and images on side A of the web of media 418. In one example, side A print engine 404 is an inkjet print engine that includes inkjet drop generators. In one example, side A print engine 404 is a thermal inkjet print engine. In one example, side A print engine 404 is a piezoelectric inkjet print engine.

Next, the web of media 418 moves through side A dryer 406, which evaporates fluid from the printing fluid and the web of media 418. In one example, side A dryer 406 includes heating elements and fans to blow heated air onto the web of media 418 and exhaust air from side A dryer 406. In one example, side A dryer 406 is similar to dryer 112 (shown in FIG. 2). In one example, side A dryer 406 is similar to dryer 248 (shown in FIG. 4).

Next, the web of media 418 travels through media turn-over mechanism 408 that turns the web of media 418 over for printing on side B of the web of media 418.

Side B print engine 410 deposits printing fluid on side B of the web of media 418 to print user content text and images on side B of the web of media 418. In one example, side B print engine 410 is an inkjet print engine that includes inkjet drop generators. In one example, side B print engine 410 is a thermal inkjet print engine. In one example, side B print engine 410 is a piezoelectric inkjet print engine.

Next, the web of media 418 moves through side B dryer 412, which evaporates fluid from the printing fluid and the web of media 418. In one example, side B dryer 412 includes heating elements and fans to blow heated air onto the web of media 418 and exhaust air from side B dryer 412. In one example, side B dryer 412 is similar to dryer 250 (shown in FIG. 3).

Next, the web of media 418 travels through quality monitoring module 414, which scans the printed text and images for defects. The web of media 418 is taken up on rewinder 416. In other examples, the web of media 418 travels through post-processing equipment, such as machines for cutting, punching, folding, and stacking the printed media, where the web of media 418 is processed into books, papers, pamphlets, magazines, or other suitable formats.

Web press system 400 includes a web press system controller 420 that is communicatively coupled to unwinder 402, side A print engine 404, side A dryer 406, media turn-over mechanism 408, side B print engine 410, side B dryer 412, quality monitoring module 414, and rewinder 416 via communications path 422. Web press system controller 420 controls and coordinates the operation of web press system 400. Web press system controller 420 manages press subsystems including media supply and rewind systems, print engines, ink delivery systems, media dryers, and in-line process monitoring.

Web press system 400 also includes a digital front end 424, a press interface adapter (PIA) and frame broker 426, and a print engine controller 428. The digital front end 424 is communicatively coupled to PIA and frame broker 426 via communications path 430, and to a user work station 432 via communications path 434. PIA and frame broker 426 is communicatively coupled to print engine controller 428 via communications path 436. Web press system controller 420 is communicatively coupled to digital front end 424, PIA and frame broker 426, print engine controller 428, and, optionally, user work station 432 via communications path 422.

Print engine controller 428 includes a side A print engine controller **428*a* and a side B print engine controller 428*b*. In one example, print engine controller 428 is similar to print engine controller 32 (shown in FIG. 1). In one example, print engine controller 428 is similar to print engine controller 120 (shown in FIG. 2). In one example, print engine controller 428 is similar to print engine controller 204 (shown in FIG. 3**).

Side A print engine controller **428*a* is communicatively coupled to side B print engine controller 428*b* via communications path 438 and to side A print engine 404 via communications path 440. Side B print engine controller 428*b* is communicatively coupled to side B print engine 410 via communications path 442. In one example, side A print engine controller 428*a* is similar to side A print engine controller 204*a* (shown in FIG. 3). In one example, side B print engine controller 428*b* is similar to side B print engine controller 204*b* (shown in FIG. 3**).

Digital front end 424 provides a user interface to web press system 400. A user accesses digital front end 424 via user work station 432. The digital front end 424 processes print job ticketing and controls raster image processors (RIPs), where the raster image processing can be done offline.

PIA and frame broker 426 interfaces digital front end 424, including the RIPs, to print engine controller 428. PIA and frame broker 426 includes a side A frame broker **426*a* that communicates with side A print engine controller 428*a*, and a side B frame broker 426*b* that communicates with side B print engine controller 428*b*. PIA and frame broker 426 and print engine controller 428 buffer frames from the RIPs, control the sequence of printing frames, and deliver frames to print engines 402 and 410**.

Print engine controller 428 controls print engines 402 and 410 to print user content text and images on sides A and B of the web of media 418. Side A print engine controller **428*a* controls side A print engine 402. Side B print engine controller 428*b* controls side B print engine 410. Each of the print engine controllers 428*a* and 428*b* includes hardware and software for performing the tasks described in this disclosure. In one example, each of the print engine controllers 428*a* and 428*b* is similar to controller 32 (shown in FIG. 1) and includes a processor, memory, also referred to as machine-readable (or computer-readable) storage media, and a network interface, similar to one example of controller 32**.

Figure 7:
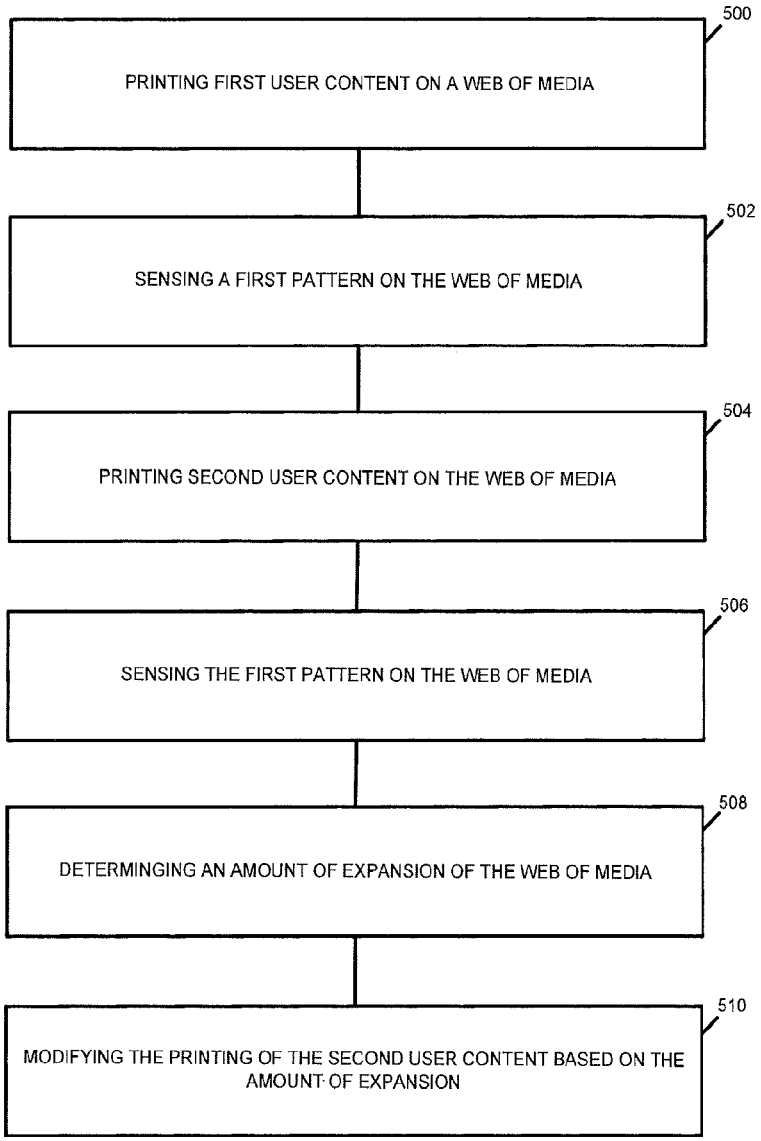
FIG. 7 is a flow chart diagram illustrating one example of a method of web press printing that compensates for cross-web expansion in a web of media

FIG. 7 is a flowchart diagram illustrating one example of a method of web press printing that compensates for cross-web expansion in a web of media. The web of media, such as the web of media 22 (shown in FIG. 1), moves in the web advance direction through a web press system, such as web press system 20 of FIG. 1.

At 500, a first printbar, such as first printbar 24, deposits printing fluid on the web of media as the web of media moves through the web press system. The web of media expands due to the printing fluid deposited on the web of media by the first printbar.

Next, at 502 a first sensor, such as first sensor 26, senses a pattern on the web of media after expansion of the web of media due to printing fluid deposited on the web of media by the first printbar. The first sensor provides sensor data that indicates the positions of the pattern in the cross-web direction on the web of media.

Next, at 504, a second printbar, such as second printbar 28, deposits printing fluid on the web of media. The web of media expands again due to the printing fluid deposited on the web of media by the second printbar.

At 506, a second sensor, such as second sensor 30, senses the same pattern on the web of media after expansion of the web of media due to printing fluid deposited on the web of media by the second printbar. The second sensor provides sensor data that indicates the position of the pattern in the cross-web direction on the web of media.

At 508, a controller, such print engine controller 32, receives the sensor data from the first sensor and the second sensor and determines the amount of expansion of the web of media in the direction perpendicular to the web advance direction, i.e., in the cross-web direction.

At 510, the controller modifies the printing performed by the second printbar based on the amount of expansion of the web of media. This compensates for the measured expansion of the web of media and reduces cross-web color to color misalignment.

Figure 8:
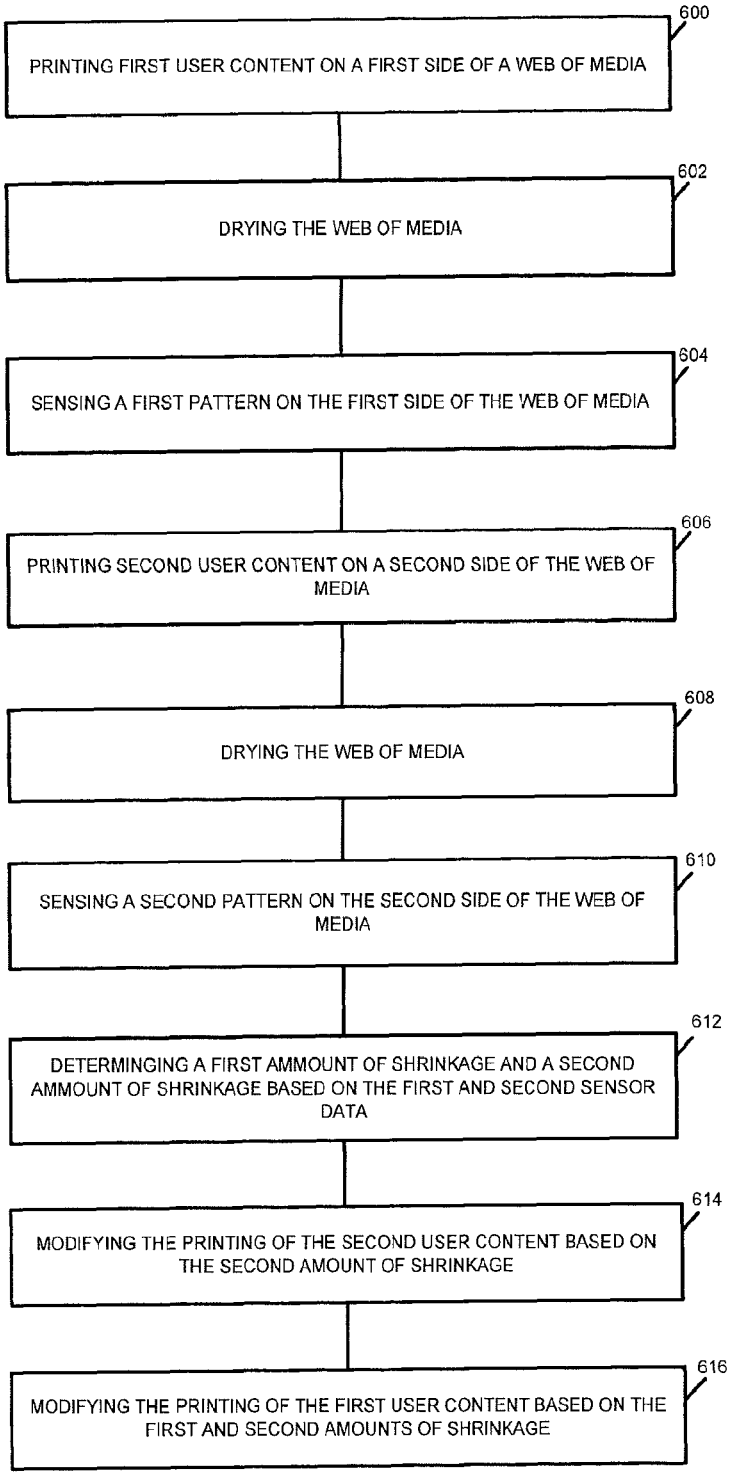
FIG. 8 is a flow chart diagram illustrating one example of a method of web press printing that compensates for cross-web expansion and cross-web shrinkage of a web of media.

FIG. 8 is a flowchart diagram illustrating one example of a method of web press printing that compensates for cross-web shrinkage of a web of media. The web of media, such as the web of media 202 (shown in FIG. 3), moves in the web advance direction through a web press system, such as web press system 200 of FIG. 3.

At 600, a side A printbar, such as first side A printbar 208, deposits printing fluid on side A of the web of media to print first user content on side A of the web of media. The web of media expands due to the printing fluid deposited on side A by the side A printbar.

Next, at 602, the web of media moves through a side A dryer, such as side A dryer 248, which evaporates fluid from the printing fluid and the web of media. As the side A dryer dries the printing fluid and the web of media, the web of media shrinks in the cross-web direction, where media expansion and shrinkage in the cross-web direction, usually, results in a net cross-web shrinkage of the web of media.

At 604, a side A sensor, such as fifth side A sensor, senses a side A pattern after shrinkage of the web of media due to drying of the printing fluid and the web of media. The side A sensor provides sensor data that indicates the position of the side A pattern in the cross-web direction on the web of media 202.

Next, at 606, a side B printbar, such as first side B printbar 228, deposits printing fluid on side B of the web of media to print second user content on side B of the web of media. The web of media expands due to the printing fluid deposited on side B by the side B printbar.

Next, at 608, the web of media travels through a side B dryer, such as side B dryer 250, which evaporates fluid from the printing fluid and the web of media. As the side B dryer dries the printing fluid and the web of media, the web of media shrinks in the cross-web direction, where media expansion and shrinkage in the cross-web direction, usually, results in a net shrinkage of the web of media.

At 610, a side B sensor, such as fifth side B sensor 244, senses a side B pattern after shrinkage of the web of media due to drying of the printing fluid and the web of media. The side B sensor provides sensor data that indicates the position of the side B pattern in the cross-web direction on the web of media.

At 612, a side A print engine controller, such as side A print engine controller 204*a*, determines a first amount of shrinkage of the web of media in the cross-web direction due to drying by the side A dryer. Also, at 612, the side B print engine controller determines a second amount of shrinkage of the web of media in the cross-web direction due to drying by the side B dryer. The side B print engine controller provides the second amount of shrinkage to the side A print engine controller.

At 614, the side B print engine controller modifies printing performed by side B printbars based on the expansion due to the side B printbars and the second amount of shrinkage of the web of media. This compensates for the measured expansion of the web of media due to the side B printbars and for the measured shrinkage of the web of media due to the side B dryer.

At 616, the side A print engine controller determines the overall media distortion, which is the amount of expansion due to the side A printbars and the amount of shrinkage due to the side A dryer, i.e., the first amount of shrinkage, plus the amount of expansion due to the side B printbars and the amount of shrinkage due to the side B dryer, i.e., the second amount of shrinkage. The side A print engine controller modifies printing performed by side A printbars to compensate for the side A expansion and the overall media shrinkage.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A web press printing system comprising:

a first printbar to print first user content on a first side of a web of media;

a first sensor positioned on the first side of the web of media corresponding to and situated downstream of the first printbar, as an initial printbar of a plurality of printbars, to sense a pattern on the web of media and provide first sensor data as the first printbar prints the first user content;

a second printbar to print second user content on the first side of the web of media;

a second sensor positioned on the first side of the web of media corresponding to and situated downstream of the second printbar, as a next printbar of the plurality of printbars after the initial printbar, to sense the pattern on the web of media and provide second sensor data as the second printbar prints the second user content;

a web dryer situated downstream of the second sensor to dry the web of media;

a third sensor positioned on the first side of the web of media corresponding to and situated downstream of the web dryer to sense the pattern on the web of media and provide third sensor data; and a controller to determine an amount of expansion and an amount of shrinkage of the web of media in a direction perpendicular to a web advance direction based on the first sensor data and the second sensor data and the third sensor data and to modify printing performed by the second printbar based on a net amount of the expansion and the shrinkage, wherein, in the web advance direction, the web of media is to pass, in series, the first printbar, then the first sensor, then the second printbar, then the second sensor, then the web dryer, then the third sensor.

2. The web press printing system of claim 1, comprising:

a third printbar situated downstream of the third sensor to print third user content on a second side of the web of media.

3. The web press printing system of claim 1, wherein the controller determines a first amount of expansion of the web of media in the direction perpendicular to the web advance direction due to the first printbar printing the first user content and a second amount of expansion of the web of media in the direction perpendicular to the web advance direction due to the second printbar printing the second user content.

4. The web press printing system of claim 1, comprising:

a marking system situated upstream of the first printbar to print the pattern on the web of media upstream of the first printbar.

5. The web press printing system of claim 1, the first sensor situated after the first printbar immediately adjacent the first printbar before the second printbar.

6. The web press printing system of claim 1, the first sensor comprising two or more sensors positioned on a same side of the web of media and spaced apart in the direction perpendicular to the web advance direction of the web of media to sense the pattern.

7. A web press printing system comprising:

a printbar to print user content on a side of a web of media;

a web dryer situated downstream of the printbar to dry the web of media;

a first sensor corresponding to and situated downstream of the printbar before the web dryer to sense a first pattern on the web of media and provide first sensor data as the printbar prints the user content;

a second sensor corresponding to and situated downstream of the web dryer to provide second sensor data; and a controller to determine an amount of expansion and an amount of shrinkage of the web of media in a direction perpendicular to a web advance direction based on the first sensor data and the second sensor data and to modify printing performed by the printbar based on a net amount of the expansion and the shrinkage, wherein, in the web advance direction, the web of media is to pass, in series, the printbar, then the first sensor, then the web dryer, then the second sensor.

8. The web press printing system of claim 7, comprising:

a marking system situated upstream of the printbar to print the first pattern on the web of media upstream of the printbar.

9. The web press printing system of claim 7, wherein the second sensor senses the first pattern to provide the second sensor data.

10. The web press printing system of claim 7, wherein the second sensor senses a second pattern to provide the second sensor data.

11. The web press printing system of claim 7, wherein the first sensor comprises two or more sensors positioned on a same side of the web of media and spaced apart in the direction perpendicular to the web advance direction of the web of media to sense the first pattern.

12. A method of web press printing comprising:

printing, with a first printbar, first user content on a first side of a web of media;

sensing, via a first sensor corresponding to and situated downstream of the first printbar, as an initial printbar of a plurality of printbars, a first pattern on the web of media as the first user content is printed, the first sensor positioned on the first side of the web of media;

printing, with a second printbar, second user content on the first side of the web of media;

sensing, via a second sensor corresponding to and situated downstream of the second printbar, as a next printbar of the plurality of printbars after the initial printbar, the first pattern on the web of media as the second user content is printed, the second sensor positioned on the first side of the web of media;

drying the web of media with a web dryer situated downstream of the second sensor;

sensing, via a third sensor situated downstream of the drying, the first pattern on the web of media, the third sensor positioned on the first side of the web of media;

determining an amount of expansion and an amount of shrinkage of the web of media in a direction perpendicular to a web advance direction based on data from the first sensor and the second sensor and the third sensor; and modifying the printing of the second user content based on a net amount of the expansion and the shrinkage, in the web advance direction, the web of media passing, in series, the first printbar, then the first sensor, then the second printbar, then the second sensor, then the web dryer, then the third sensor.

13. The method of claim 12, comprising:

determining a first amount of expansion of the web of media in the direction perpendicular to the web advance direction due to the printing of the first user content; and determining a second amount of expansion of the web of media in the direction perpendicular to the web advance direction due to the printing of the second user content.

14. The method of claim 12, comprising:

providing, via a marking system, the first pattern on the first side of the web of media upstream of the first printbar.

15. The method of claim 14, wherein providing the first pattern on the first side of the web of media comprises printing the first pattern on the first side of the web of media upstream of the first printbar.

16. The method of claim 12, the first sensor situated after the first printbar immediately adjacent the first printbar before the second printbar.

17. The method of claim 12, the first sensor comprising two or more sensors positioned on a same side of the web of media and spaced apart in the direction perpendicular to the web advance direction of the web of media to sense the first pattern.

* * * * *